US006848213B1

(12) United States Patent
Swapp

(10) Patent No.: US 6,848,213 B1
(45) Date of Patent: Feb. 1, 2005

(54) LOUVER MECHANISM FOR SHUTTER

(76) Inventor: Ronald L. Swapp, PMB 440-126, 1000 N. Green Valley Pkwy., Henderson, NV (US) 89074

( * ) Notice: Subject to any disclaimer, the term of this patent is extended or adjusted under 35 U.S.C. 154(b) by 0 days.

(21) Appl. No.: 10/305,556

(22) Filed: Nov. 25, 2002

Related U.S. Application Data

(60) Provisional application No. 60/332,530, filed on Nov. 26, 2001.

(51) Int. Cl.[7] ..... E06B 7/096; E06B 7/08

(52) U.S. Cl. ..... 49/82.1; 49/74.1; 52/473

(58) Field of Search ..... 49/82.1, 74.1, 49/73.1, 80.1, 403; 454/221, 224, 309, 313, 278, 314; 52/473

(56) References Cited

U.S. PATENT DOCUMENTS 5,216,837 A * 6/1993 Cleaver et al. ..... 49/82.1
5,379,551 A * 1/1995 Swapp ..... 49/82.1
5,469,658 A * 11/1995 Digianni et al. ..... 49/82.1
6,145,251 A * 11/2000 Ricci ..... 49/82.1
6,263,632 B1 * 7/2001 Cadorette ..... 52/473
6,314,680 B1 * 11/2001 Buckwalter et al. ..... 49/82.1
6,536,162 B2 * 3/2003 LaMay ..... 49/403
6,568,131 B1 * 5/2003 Milano, Jr. ..... 49/82.1

FOREIGN PATENT DOCUMENTS

IT 399130 * 11/1990 ..... 49/82.1 X

* cited by examiner

*Primary Examiner*—Hugh B. Thompson, II
(74) *Attorney, Agent, or Firm*—Gregory J. Nelson

(57) ABSTRACT

A concealed louver drive mechanism for a shutter assembly having multiple louvers. A gear rack is disposed in a channel in one of the stiles. One-piece pinions each having a gear engaging the rack and a pin end received in the end of the associated louver. The rack and pinion have relieved areas to reduce frictional resistance to movement. When one of the louvers is manually adjusted, simultaneous coordinated movement is imparted to the rack and to the other louvers.

10 Claims, 4 Drawing Sheets

LOUVER MECHANISM FOR SHUTTER

CROSS-REFERENCE TO RELATED APPLICATION

This application is related to provisional patent application Ser. No. 60/332,530, filed Nov. 26, 2001, of the same title.

FIELD OF THE INVENTION

The present invention relates to a window shutter and more particularly relates to a window shutter having adjustable louvers which are actuated by a drive mechanism within the shutter frame which translates the motion applied to one louver to all of the louvers in the shutter so that they may be simultaneously adjusted to the desired position to control passage of light.

BACKGROUND OF THE INVENTION

Various interior and exterior window treatments are utilized in both residential and commercial applications. One such widely used and accepted type of window treatment is the shutter. The shutter is popular because of its pleasing aesthetic appearance, as well as its versatility and functionality. Shutters can be manufactured to accommodate window openings of almost all sizes and shapes. Shutters may be made of wood or may be fabricated from synthetic materials or a combination of wood and synthetic materials to provide the desired appearance and resistance to environmental conditions.

A functional advantage of shutters having adjustable louvers is that the louvers can be adjusted to vary the desired light level to deflect sunlight and reduce glare. The louvers may be opened or closed as required to vary the amount of light and the heat transferred to an interior area through area through a window opening.

Generally, shutters with adjustable louvers are constructed having pivot pins at the opposite ends of the louvers which pins extend into receiving bores in the vertical stiles at the opposite sides of the louver frame. A control rod, or tilt rod, interconnects the louvers so that movement of the tilt rod will impart simultaneous pivotal movement to all of the louvers. While the tilt rod is a generally accepted mechanism for actuating or moving the louvers, it has certain disadvantages. The tilt rod is attached to the edge of the louvers and, therefore, is not always aesthetically acceptable, detracting from the overall appearance of the shutter assembly. Further, the tilt rods are generally connected to the edges of the louvers by means of U-shaped wire fasteners which can become detached or pull out of either the rod or the shutter impairing the functionality of the tilt rod.

Accordingly, there have been attempts to design shutter assemblies to eliminate the tilt rod. For example, U.S. Pat. No. 4,887,391 shows a window shutter having pivoting louvers mounted in a rectangular shutter frame and linked together for common pivotal movement by a ganging bar mounted adjacent the ends of the louvers. The bar has pins extending into each end of the louvers spaced from the pivot point of the louver. The louvers are retained in a position selected by the user without imposing significant force on the louvers by magnets mounted in the side of the frame adjacent the ganging bar.

U.S. Pat. No. 5,216,837 discloses an enclosed louver actuating mechanism which employs a rack and pinion gear system for actuating the louvers. The louver mechanism is configured so that manual rotation of one louver will cause the remaining louvers to be rotated. The louver mechanism is contained within a longitudinal slot in a stile of the louver panel and includes pinion gears engaged between opposing longitudinal gear racks. A pinion gear is provided for each louver and is located in the stile between the gear racks so that the longitudinal gear racks translate in opposite directions. Drive pins are received through the longitudinal cover into the pinion gears and then into the louver connecting the rack motion to the louvers. While this approach has some merit, the mechanism utilizing opposed gear racks and separate drive pins and gears is difficult to assemble. This mechanism also requires precise alignment and imposes substantial frictional resistance to adjustment of the louvers.

As indicated above, various attempts have been made at providing an improved mechanism for louver adjustments which allow movement or rotation of a single louver to impart rotation to the remaining louvers. However, there nevertheless exists a need for such a mechanism which can be easily manufactured, easily installed and provided to the shutter consumer at reasonable costs.

BRIEF SUMMARY OF THE INVENTION

Briefly, in accordance with the present invention, an improved concealed louver drive mechanism is provided for a shutter assembly of the type having a frame with opposite spaced-apart vertical stiles and upper and lower horizontal rails. A channel extends in at least one of the vertical stiles and opens toward the adjacent louver ends to receive a reinforcing member. A rack is disposed within the rear of the channel. Preferably the rack will have one or more projections or lands which engage the channel to reduce frictional resistance to movement of the rack relative to the channel. The rack has longitudinal gear teeth which are opposed by a bearing surface. One-piece pinions each have a gear on their inner end which engages the gear teeth on the rack. The rear face of the gear has a projection in point contact with the reinforcing member. The outer end of the pinions extend outwardly from the stile and have tapered outer ends which are adapted to be received within cooperative bores in the ends of the louvers. Splines arranged about the outer end of the pinion prevent rotation of the louver relative to the louver pinion. Thus when one of the louvers is manually rotated to position the louver blades in a desired position, movement is imparted to the rack which will, in turn, impart corresponding rotational movement to the other louvers. The rack is preferably made in sections which can be interconnected to form a rack of the desired length.

BRIEF DESCRIPTION OF THE DRAWINGS

The above and other objects and advantages of the present invention will become more apparent from the following description, claims and drawings in which:

DETAILED DESCRIPTION OF THE DRAWINGS

Figure 1:
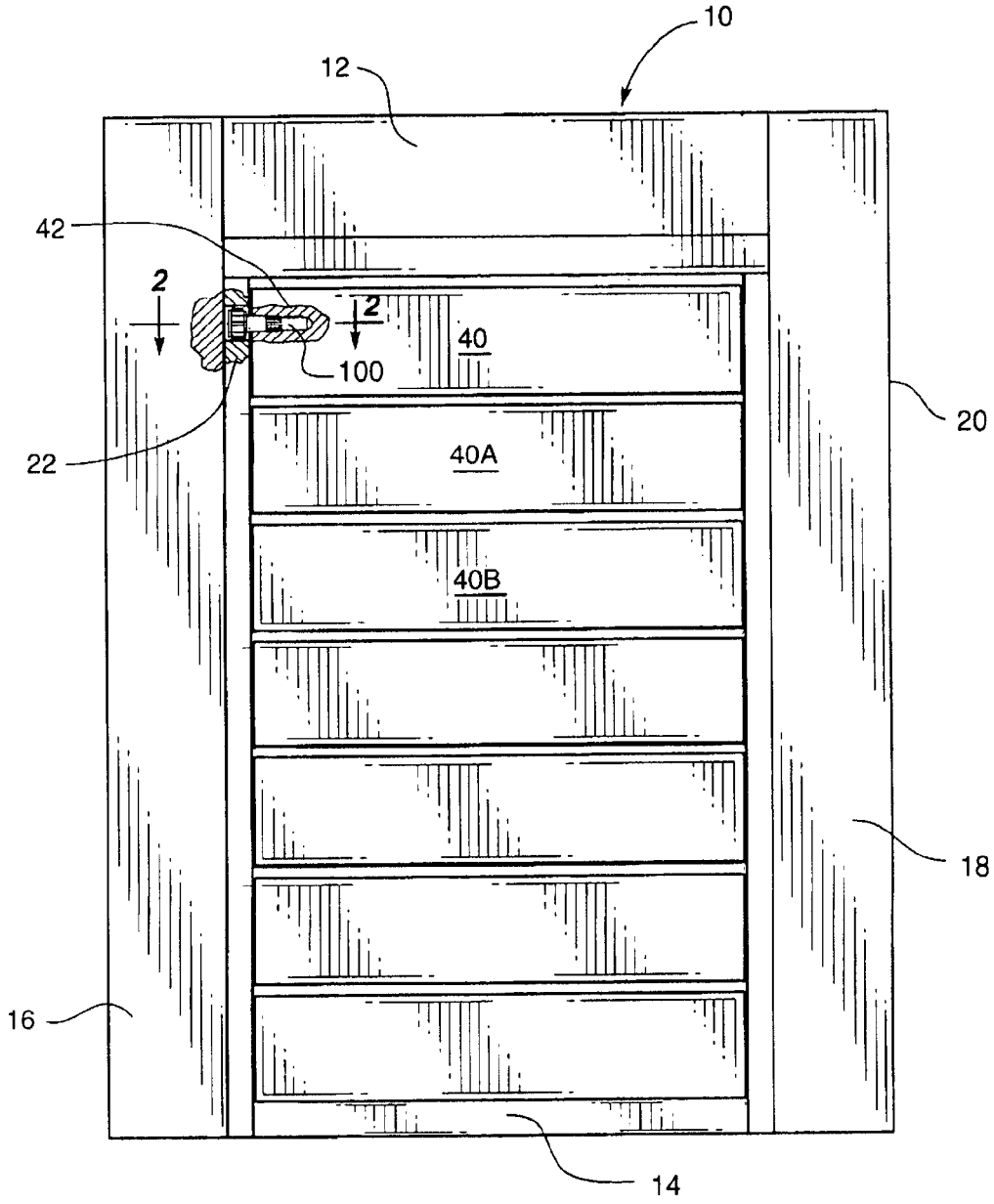
FIG. 1 is a front view of a shutter assembly incorporating the louver drive mechanism of the present invention broken away to better illustrate the various components.

Turning now to the drawings, a preferred embodiment of the drive mechanism according to the present invention is shown in connection with a shutter designated by the numeral 10. The shutter has an upper horizontal rail 12, a lower horizontal rail 14 and opposite vertical stiles 16, 18 formed into a frame 20 which is shown as generally rectangular. The frame 20 may be fabricated from any suitable material such as wood, metal, plastic or a polymeric material such as PVC, polyethylene, polypropylene. The components are preferably fabricated by either a shaping or molding process and suitably finished.

A channel 22 is formed in at least one of the vertical stiles 16 which channel opens at the inner face 24 of the stile so that the stile 16 has a generally U-shaped configuration. In FIG. 1, the channel 22 is in the stile 16. A rigid reinforcing member 30 extends vertically within the channel or recess in the vertical stiles. The reinforcing member 30 may be wood, plastic and is preferably an extruded aluminum tubular member which is generally rectangular in cross section and which will reinforce the frame and also provide a bearing surface for the drive mechanism components as will be explained hereafter and which strengthens the stile against warpage.

A plurality of louvers 40, 40A, 40B, etc., are pivotally mounted in the shutter frame assembly extending in parallel relationship between the opposite stiles 16 and 18. The louvers are connected to a drive mechanism so that adjustment or rotation of one of the louvers will impart corresponding rotation or movement to the other louvers by means of a gear rack within a stile.

The drive assembly consists of a longitudinally extending rack 50 located within the recess or channel 22 in the stile. A pinion 100 is associated with each louver. The pinions 100 have an integral gear and drive pin engageable in the edge of the louver. A cover 120 having spaced-apart bores 122 corresponding to the spacing of the louvers encloses the channel 22 with the ends of the pinion pins 132 projecting through the bores into the associated louver. The rack and pinions have projections to provide point contact and reduce friction, as will be described in greater detail below.

Figure 4:
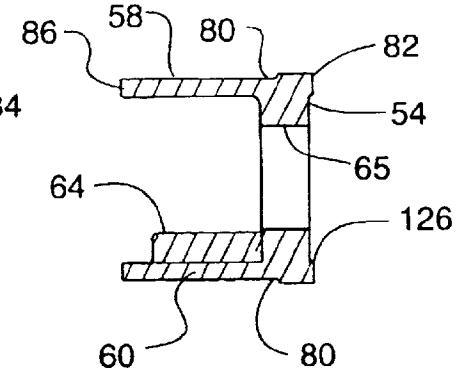
FIG. 4 is a sectional view taken along line 4—4 of FIG. 3.
Figure 5:
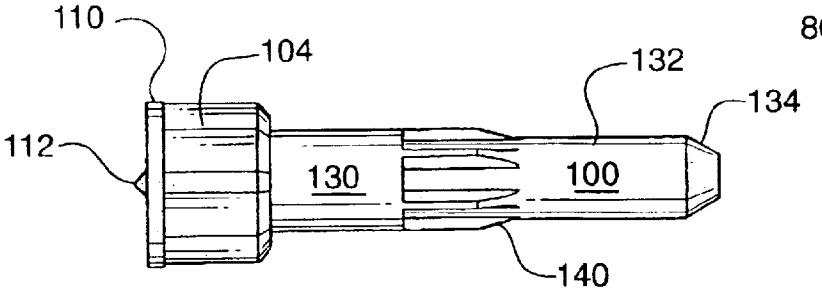
FIG. 5 is a detail view of the integral gear and louver pin.
Figure 3:
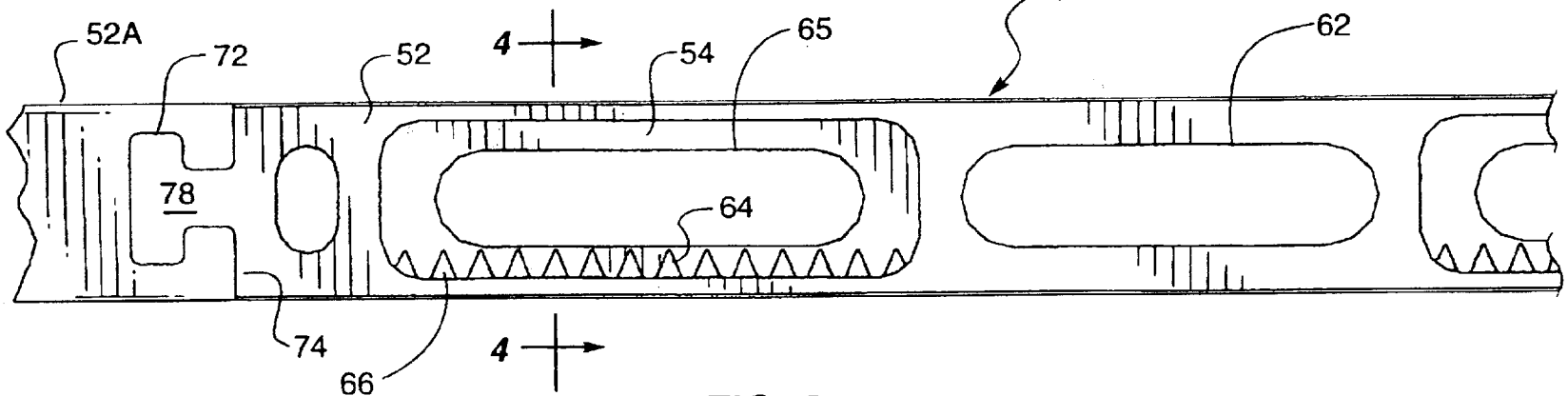
FIG. 3 is a rear view of several longitudinally extending gear rack sections.
Figure 6:
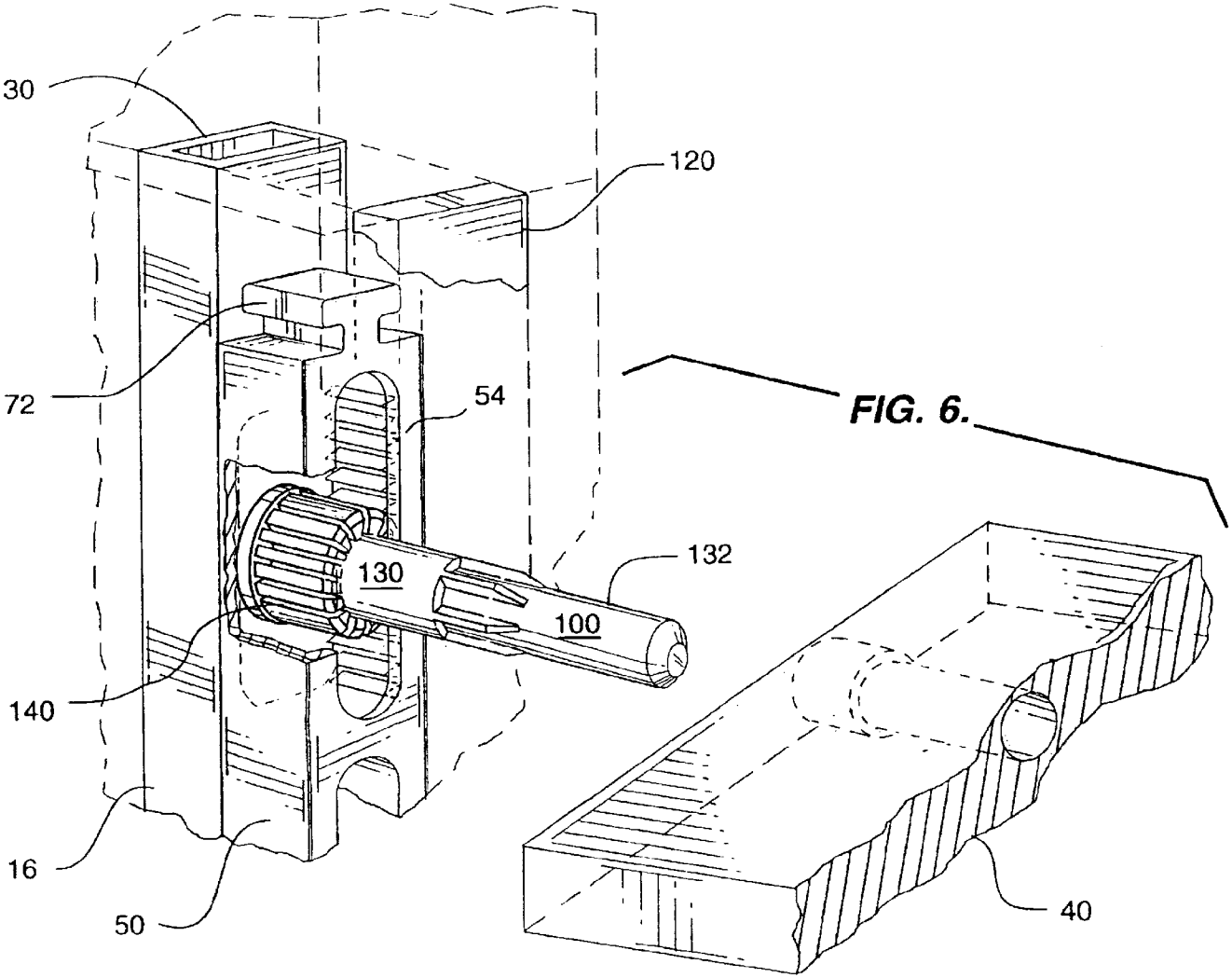
FIG. 6 is a perspective view, partly broken away, illustrating a portion of a stile and rack and integral gear and pin assembly.

Turning now to FIGS. 3 and 4, the rack 50 is shown in greater detail. The rack is comprised of a number of sections 52, 52A of predetermined length and preferably fabricated from a suitable plastic material. The rack 50 has walls 54, top flange 58 and bottom flange 60 forming a generally U-shaped structure. The wall 54 of the rack has a plurality of longitudinally extending slots 62 to reduce the weight and material requirements for the rack. A plurality of linear teeth 64 extend along the lower flange. The teeth 64 may extend the entire length of the rack or may be provided in a series of segments 66 of predetermined length. The length of the segments 66 of the gear rack should extend beyond the length of the slots 65 in the wall of the rack as this dimension determines the extent of movement or rotation that will be imparted to the louvers.

One end of each of the gear racks 52, 52A is provided with a T-shaped recess 72 in its rear wall and the opposite end 74 is provided with a corresponding T-shaped tab 78. It will be apparent, as seen in FIG. 3, that the gear rack can be provided in sections and sections joined together to form a unitary rack of a desired length in accordance with the length of the channel in which the rack is to be installed.

Figure 2:
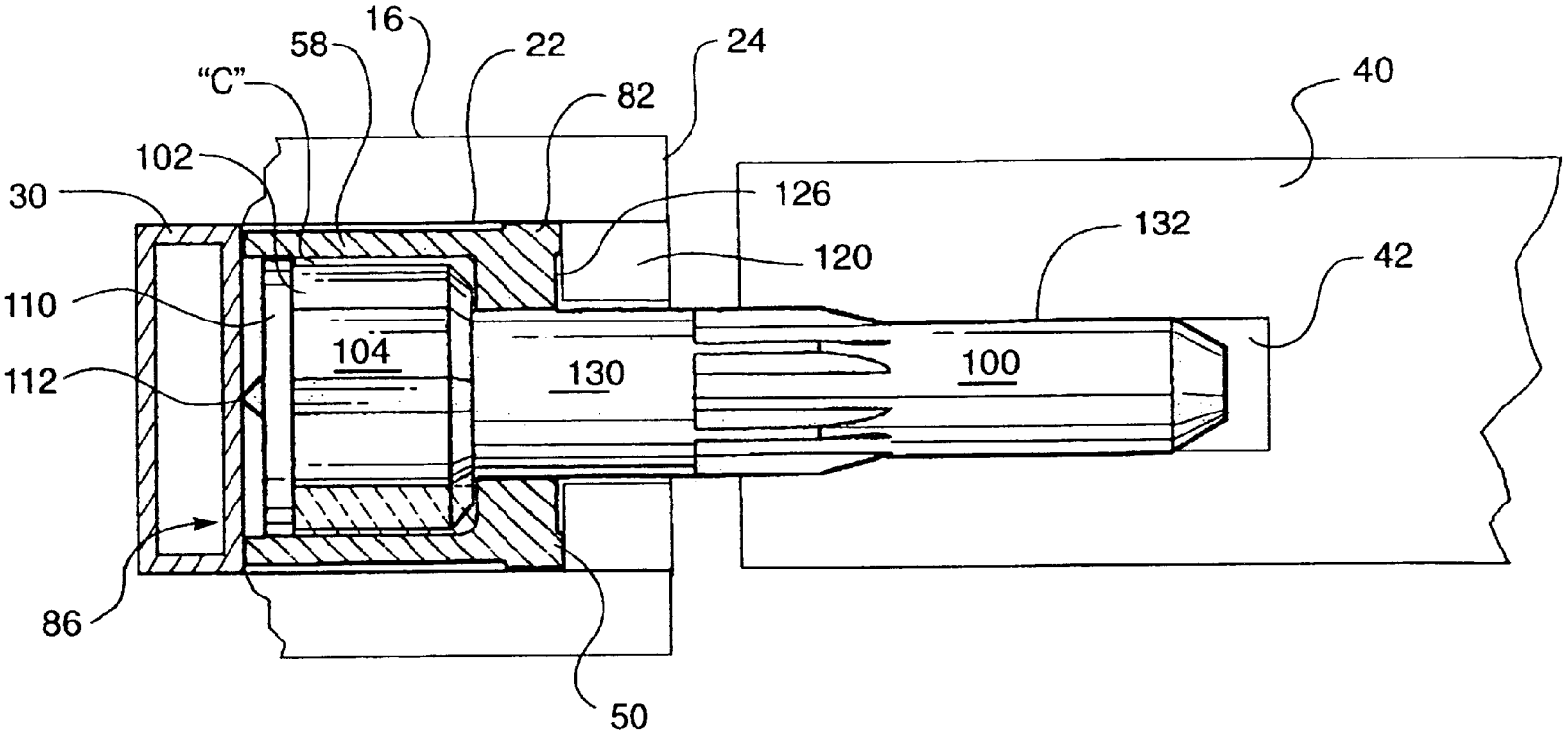
FIG. 2 is a sectional view taken along line 2—2 of FIG. 1.

Referring to FIGS. 2 and 3, it will be seen that the outer surfaces of the top and bottom flanges 58, 60 are both provided with a slight relief at 80 forming lands 82 at the corners of the gear rack. The lands 82 surfaces engage the inner surface of the recess or channel 22 in the stile. Similarly, the rear surface of the upper and lower flange have lands 86 which engage the metal reinforcing insert extending within the stile channel.

Pinions 100 are inserted at spaced-apart locations in the channel 22 corresponding to the location of the louvers. In the normal, open position, each of the pinions is centered with respect to the associated slot 65 in the rack. This allows the rack to move or translate in both directions as louvers move from an open position to either an upwardly or downwardly inclined, closed position.

Each of the pinions 100 includes a gear 102 having teeth 104 with a pitch diameter compatible with the linear gear on the gear rack. The diameter of the gear is selected so that a small clearance "C" is provided between the periphery of the gear and the upper inner surface of the upper flange as best seen in FIG. 2. A circular flange 110 is concentric with the gear and extends beyond the periphery of the gear in close proximity to the inner surface of the top and bottom flanges 58, 60. Thus the circular flange 110 is captured within the rack and will tend to maintain the gear in alignment when it is rotated. A small conical projection 112 extends rearwardly from the center of the circular flange 110 engaging the reinforcing member 30 within the stile channel. In this way, minimal point contact is maintained between each pinion 100 and the insert reducing frictional resistance to rotation. It will be noted that the front of wall 54 of the gear rack is also undercut at 126 to provide reduced surface area contact between the inner surface of the cover and the front of the gear rack.

The channel is enclosed by a cover 120 which has a plurality of bores 122 through which the pinions extend. The cover strip 120 may be frictionally retained in the stile or may be secured by suitable adhesives.

Each pinion 100 includes an intermediate section 130 which is circular and which is received within a corresponding bore in the cover. The outer end of each pinion comprises a pin 132 of reduced diameter tapering at its outer end 134 so that it may be easily inserted into a corresponding bore 42 in the edge of the louver. A plurality of splines 140 having tapered outer ends are provided between the intermediate section 130 and pin 132 to couple the rotation of the pinion and louver.

When the shutter with the drive assembly is assembled as shown in the drawings, manual rotation imparted in one of the louvers will be imparted to all of the louvers by the gear assembly. It is only necessary that the drive rack be installed in one of the stiles. The louver edges adjacent the stile in which the drive assembly is installed will receive a pivot pin engageable in the bore 42 in the louver. However, in some installations it may be desirable to place a drive assembly in both of the stiles 16, 18 at the opposite ends of the louver.

The length gear rack will be selected to allow movement or reciprocation of the rack relative to the stile in both directions. The rack can be assembled by joining individual sections of the rack to form an overall rack length as required. When installed, the rear of the rack engages the reinforcing insert 30 within the stile. The rack will be placed in a centered position with a plurality of pinions inserted at spaced-apart locations along the rack. The pinions will generally be inserted at locations which correspond to the approximate center of the adjacent slots in the front surface of the gear rack. The gear rack and pinion gears are then enclosed within the stile channel placing the cover with the aligned bores in position. The bores 42 in the ends of the louvers are then aligned with the tapered ends of the louver pins and inserted manually, or through the use of a tool which maintains proper alignment while engaging the pin to the louver.

Once the desired number of louvers have been positioned on the pins, the opposite stile is brought into position in engagement with the pivot pins at the opposite edge of the louver. The upper and lower rails are also affixed and secured by a suitable fastener or an adhesive or bonding agent. The rack will serve as an actuator for the coordinated movement of the louvers. It will be seen that when the user manually rotates a selected one of the louvers, the associated drive pin and gear will also be rotated. The splines on the outer end prevent relative rotation between the louver and the pin. The rotation of the drive pin and gear will be transmitted to the gear rack moving it in one direction or the other. The movement or translation of the gear rack will be transferred to a corresponding rotation of the remaining louvers.

In this way, use of unsightly or unreliable control rods is removed. The entire actuating mechanism is conveniently deposed in an out-of-sight location. The use of a gear rack with linear teeth on only one surface of the rack eliminates possible binding, misalignment and reduces overall frictional resistance to rotation.

As pointed out above, the surfaces of the gear rack contacting the channel undercut would reduce frictional resistance to movement of the gear rack. The inner surface of the drive pin rotates about a small projection or cone providing limited contact surface between the gear and the insert at the rear of the recess.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A drive assembly for a shutter having a frame with opposed stiles with at least two louvers having opposite ends extending between the stiles, one of said stiles defining a longitudinally extending groove, said drive assembly comprising:

(a) a rack in positionable said groove having:
  (i) a wall with first and second flanges having inner and outer surfaces defining a generally U-shaped longitudinal channel;
  (ii) one of said flanges having a linear gear extending along an inner surface of one of said flanges;
  (iii) said wall defining a bore; and (b) a one-piece pinion associated with the end of one of said louver, each said pinion comprising:
  (i) a pin having an outer end extending through said bore receivable in the end of a louver and an inner end; and
  (ii) a drive gear on the inner end of the pinion positioned between the flanges and engaging said linear gear to reciprocate the rack to drive adjacent louvers.

2. The drive assembly of claim 1 further including a metal reinforcing member in said channel positioned adjacent said rack and pinion.

3. The drive assembly of claim 1 wherein said rack is formed in linear segments each having mating end sections whereby multiple segments may be linearly connected.

4. The drive assembly of claim 1 further including a cover strip extending over said channel having bores therein corresponding to the location of louver pins.

5. The drive assembly of claim 1 wherein said outer end of said pin is provided with splines.

6. The drive assembly of claim 1 wherein said drive gear is provided with a circular flange having a diameter greater than the drive gear to center the pinion with respect to the U-shaped channel.

7. The drive assembly of claim 2 wherein said gear has a projection engaging said reinforcing member to minimize friction.

8. The drive assembly of claim 1 wherein said rack has a land area on its outer surface contacting the groove to reduce frictional resistance to translation movement of said rack.

9. The drive assembly of claim 1 wherein said rack and pinion are plastic.

10. The drive assembly of claim 1 wherein said rack has relieved areas to reduce weight.

* * * * *